US009181786B1

(12) United States Patent
Portman

(10) Patent No.: US 9,181,786 B1
(45) Date of Patent: Nov. 10, 2015

(54) SEA FLOOR BOOST PUMP AND GAS LIFT SYSTEM AND METHOD FOR PRODUCING A SUBSEA WELL

(71) Applicant: Baker Hughes Incorporated, Houston, TX (US)

(72) Inventor: Lance Portman, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/491,593

(22) Filed: Sep. 19, 2014

(51) Int. Cl.

| | |
|---|---|
| ***E21B 43/01*** | (2006.01) |
| ***E21B 43/12*** | (2006.01) |
| ***E21B 43/36*** | (2006.01) |
| ***E21B 47/06*** | (2012.01) |
| ***E21B 34/06*** | (2006.01) |
| ***E21B 43/40*** | (2006.01) |

(52) U.S. Cl.
CPC ..... *E21B 43/128* (2013.01); *E21B 34/06* (2013.01); *E21B 43/36* (2013.01); *E21B 43/40* (2013.01); *E21B 47/06* (2013.01)

(58) Field of Classification Search
CPC ... E21B 43/122; E21B 33/035; E21B 21/063; E21B 43/121; E21B 43/128; E21B 43/40; E21B 34/06; E21B 43/36; E21B 47/06
USPC ..... 166/357, 401, 263
See application file for complete search history.

(56) References Cited

U.S. PATENT DOCUMENTS

| | | | | |
|---|---|---|---|---|
| 4,633,954 | A * | 1/1987 | Dixon et al. | 166/372 |
| 6,129,150 | A * | 10/2000 | Lima | 166/357 |
| 6,651,745 | B1 * | 11/2003 | Lush et al. | 166/357 |
| 7,152,681 | B2 | 12/2006 | Olsen et al. | |
| 7,565,932 | B2 | 7/2009 | Lawson | |
| 7,604,064 | B2 | 10/2009 | Irwin, Jr. | |
| 7,654,319 | B2 | 2/2010 | Chitty et al. | |
| 7,708,059 | B2 | 5/2010 | Shaw | |
| 7,882,896 | B2 | 2/2011 | Wilson et al. | |
| 8,141,625 | B2 | 3/2012 | Reid | |
| 8,714,264 | B2 | 5/2014 | Fay | |
| 2005/0072574 | A1 * | 4/2005 | Appleford et al. | 166/366 |
| 2007/0131429 | A1 * | 6/2007 | Brammer | 166/357 |
| 2007/0274842 | A1 * | 11/2007 | Campen et al. | 417/53 |
| 2009/0008101 | A1 * | 1/2009 | Coady | 166/370 |
| 2011/0132615 | A1 * | 6/2011 | Gonzalez et al. | 166/366 |
| 2011/0168413 | A1 * | 7/2011 | Bachtell et al. | 166/401 |

FOREIGN PATENT DOCUMENTS

| | | | |
|---|---|---|---|
| GB | 2329658 | A * | 3/1999 |
| RU | 2168614 | C1 | 6/2001 |
| WO | WO 2014/027895 | A1 | 2/2014 |

OTHER PUBLICATIONS

U.S. Appl. No. 14/328,345—entitled: "Submersible Pump Assembly Inside Subsea Flow Line Jumper and Method of Operation".

* cited by examiner

*Primary Examiner* — James G Sayre
(74) *Attorney, Agent, or Firm* — Bracewell & Giuliani LLP

(57) ABSTRACT

A method and system for producing a subsea well includes installing a pump and a gas/liquid separator on a sea floor. The system flows well fluid up the well to the pump, boosting the pressure of the well fluid. The system flows the well fluid from the pump into the gas/liquid separator and separates gas from the well fluid. The stream of liquid flows up a flow line to a remote production facility. The stream of gas is injected back into the well at a selected depth to mix with the well fluid flowing up the well. The injection of gas creates a gas lift system that lightens the hydrostatic pressure of the well fluid in the well.

18 Claims, 4 Drawing Sheets

SEA FLOOR BOOST PUMP AND GAS LIFT SYSTEM AND METHOD FOR PRODUCING A SUBSEA WELL

FIELD OF THE DISCLOSURE

This disclosure relates in general to subsea wells and in particular to a sea floor booster pump and gas separator for directing a liquid well stream to the surface and re-injecting gas into a well for gas lift.

BACKGROUND

Subsea hydrocarbon wells in deep water initially have enough natural or reservoir pressure to flow the well fluids to a wellhead at the sea floor, plus up a riser or flow line to a processing facility at the sea surface. The reservoir pressure declines over time, and eventually becomes inadequate to lift the well fluid to the surface processing facility, which may be thousands of feet above the sea floor. Even though the well may have sufficient pressure to lift the column to the sea floor, it may have to be closed in unless some type of artificial lift is employed.

Well submersible pumps are commonly used in land-based wells to pump the well fluid to the wellhead when the reservoir pressure is inadequate. One type of submersible well pump is an electrical submersible pump (ESP), which normally employs a three-phase electrical motor to drive a centrifugal pump. In most installations, the ESP is supported on a string of production tubing extending into the well. ESPs are capable of not only lifting the column of well fluid to the wellhead, but if installed in a subsea well, also up a riser or flow line to a production facility. However, ESPs have to be pulled from the well from time to time for maintenance or replacement. In deep water, pulling an ESP from a subsea well is very expensive. Normally, a semi-submersible drilling rig is required to pull the production tubing and the ESP from a well. Consequently, operators are reluctant to install ESPs in deep water subsea wells.

Sea floor pumps have been proposed to boost the pressure of the well fluid flowing out of the wellhead. A sea floor pump lifts the column of well fluid from the sea floor to a production facility at the surface. However, sea floor pumps are also quite expensive if installed in deep water.

Both land-based and subsea wells have used a technique known as gas lift to enhance production of a well. In one technique, a gas lift mandrel will be secured in the production tubing. The gas lift mandrel has a port leading from the tubing annulus surrounding the production tubing to the interior of the production tubing. A check valve can be lowered on a wireline through the tubing and installed in the gas lift mandrel. The operator pumps compressed gas into the tubing annulus, which flows through the check valve into the column of well fluid in the production tubing. The injected gas lightens the column of well fluid in the tubing, facilitating flow to the well head. A drawback to subsea gas lift is the requirement for a gas source and compressor to inject the gas into the tubing annulus. In deep water, the gas source and compressor would likely need to be located on the sea floor. The cost may be too much for deep water offshore wells.

SUMMARY

A method for producing a subsea well includes installing a pump and a gas/liquid separator on a sea floor. A discharge of the pump connects to an inlet of the separator. The method includes flowing a well fluid up the well, and with the separator separating gas from liquid. The separated liquid flows from the separator to a remote production facility. The separated gas is injected at a selected depth into the same well or into another well and into the well fluid flowing up the well to serve as a gas lift.

The well employs production tubing that may have a port located at the selected depth. The injected gas flows into the port in the production tubing. The port may be in a gas lift mandrel containing a check valve. The gas is injected into the production tubing annulus surrounding the production tubing.

Alternately, if the production tubing does not have a gas lift mandrel, the operator may lower an injection line into the production tubing to the selected depth. The gas is injected into the injection line.

The pump may be an electrical submersible pump installed in a flow line jumper on the sea floor. If so, the gas separator is installed on the sea floor outside of the flow line jumper. The flow line jumper is retrievable with the pump inside.

The method may include sensing a ratio of gas to liquid in the well fluid flowing to the pump. The system may inject gas from a storage facility into the well if the ratio due to inadequate naturally produced gas is less than a desired amount.

The system may include a plurality of subsea wells that are connected to a manifold. Well fluid flows from each of the wells to the manifold, and from the manifold to the pump. The system injects at least some of the gas separated by the separator into at least one of the wells.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE DISCLOSURE

Figure 1:
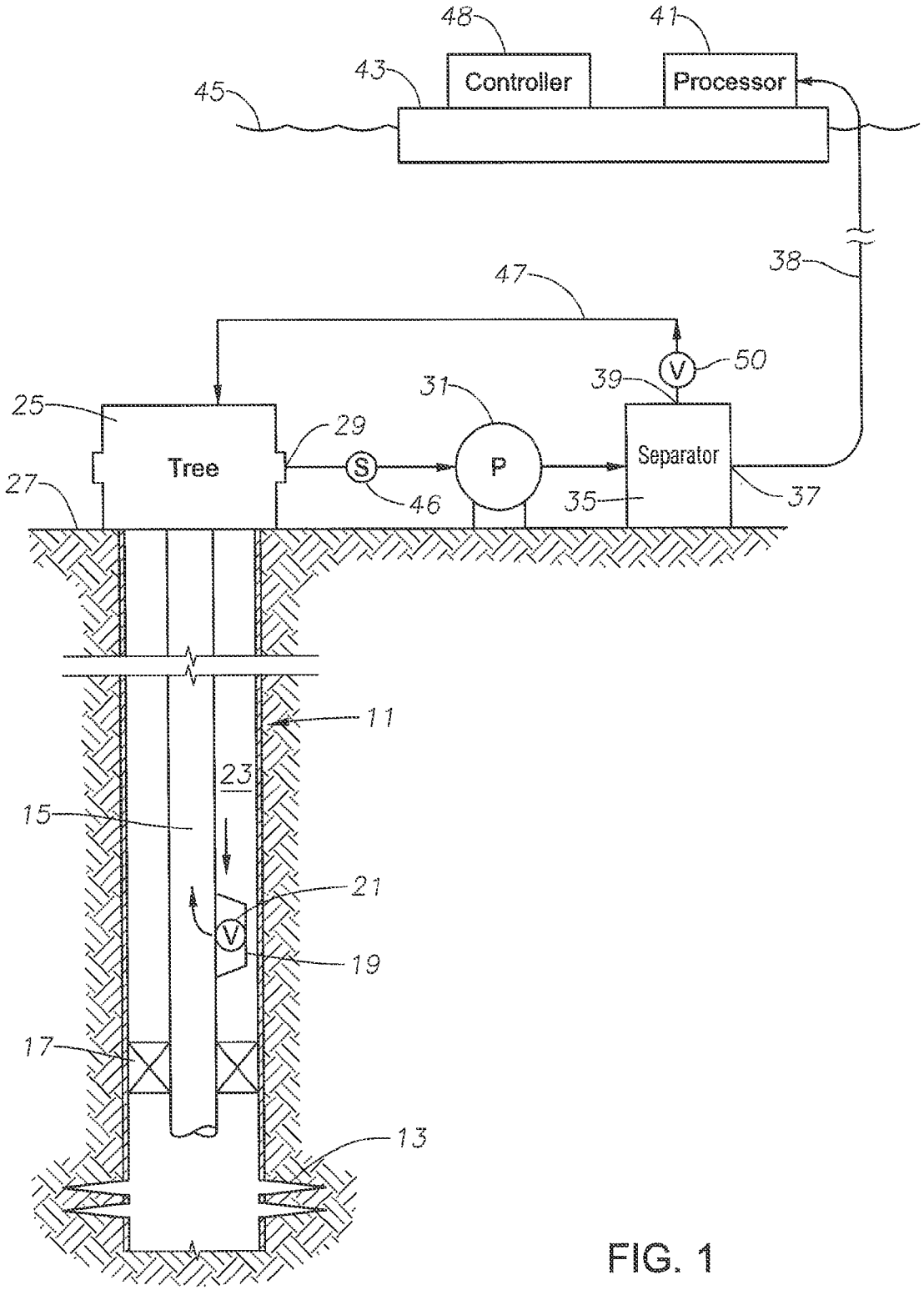
FIG. 1 is a schematic view of one embodiment of a subsea well pumping system in accordance with this disclosure.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, it is to be understood that the specific terminology is not limiting, and that each specific term includes equivalents that operate in a similar manner to accomplish a similar purpose.

Referring to FIG. 1, cased well 11 has openings, such as perforations 13 for admitting well fluid. Cased well 11 may be vertical, as shown, or it may be inclined or have a horizontal section. A string of production tubing 15 extends into cased well 11. A packer 17 may be employed above perforations 13 to isolate the lower open end of production tubing 15 from cased well 11 above packer 17. In FIG. 1, cased well 11 is arranged for a gas lift operation and has a gas lift mandrel 19, which may also be called a side pocket mandrel, secured into production tubing 15 above packer 17. Gas lift mandrel 19 is a conventional device having a check valve 21 that is normally retrievable and installable on a wire line (not shown) lowered into production tubing 15. Check valve 21 is located within a port in production tubing 21 that has an inlet side in communication with an annulus 23 surrounding production tubing 15. An outlet side of check valve 21 is in fluid communication with the interior of production tubing 15. Gas lift mandrel 19 is located a selected depth in cased well 11, which may be only a few feet above packer 17.

A production tree 25 located at the upper end of cased well 11 supports production tubing 15. Tree 25 will be located at or near sea floor 27. Tree 25 has an outlet 29 for discharging well fluid flowing up tubing 15.

Tree outlet 29 leads to a pump 31 capable of pumping well fluid containing liquid and a significant percentage of gas, possibly 40 percent or more. Pump 31 is also located at or near sea floor 27, and it may be a multi-phase pump of a type too large in diameter to be installed in cased well 11.

The discharge of pump 31 connects to the inlet of a gas/liquid separator 35, also located at or near sea floor 27. Separator 35 may be a conventional type that has no moving parts and separates gas and liquid using a vortex structure or gravity or both. Separator 35 has a higher density or liquid outlet 37 that discharges a higher density stream containing predominately liquid. Separator 35 has a lower density or gas outlet 39 that discharges predominately gas. Preferably, the flowing pressures at higher density outlet 37 and lower density outlet 39 are substantially the same. Higher density outlet 37 connects to a riser or flow line 38 that extends to a remote well fluid processor 41, which may be on a production vessel 43 at the sea surface 45. Lower density outlet 39 connects to a sea floor injection line 47 that extends back to tree 25. Sea floor injection line 47 is in fluid communication with well annulus 23.

Various sensors 46 are at the inlet of pump 31 to sense fluid parameters such as the well fluid flowing pressure, temperature and/or flow rate. A controller 48, normally on production vessel 43, is in electrical communication with sensors 46. A choke or valve 50 at low density outlet 39 is controlled by controller 48 to change the flow area through injection line 47. A choke or valve (not shown) could also be located at higher density outlet 37 of gas separator 35. The various chokes and valves may be either fixed or variable to control the amount of gas being re-injected into cased well 11. Controller 48 may optionally control the speed of pump 31.

In the operation of the embodiment of FIG. 1, well fluid flowing from perforations 13 may comprise a mixed flow of liquid and gas. Pump 31 increases the pressure of well fluid flowing from tree outlet 29 and delivers the well fluid at a higher pressure to separator 35. Separator 35 separates at least a portion of the gas from the well fluid and delivers the higher density well fluid out higher density outlet 37 to flow line 38. An additional pump downstream of separator 35 to pump the higher density fluid up flow line 38 is not required. Separator 35 delivers the lower density stream from lower density outlet 39 to sea floor injection line 47. The lower density fluid, predominately gas, flows down annulus 23, enters check valve 21 of gas lift mandrel 19 and flows into the interior of production tubing 15. The lower density fluid mixed with the well fluid flowing from perforations 13, lightens the weight of the column of well fluid in production tubing 15. The reduced hydrostatic head of the column of well fluid in tubing 15 above gas lift mandrel 19 facilitates the flow of well fluid up production tubing 15.

Based on the pressure sensed by sensors 46, controller 48 may increase or decrease the opening of choke 50. Controller 48 may also increase the speed of the motor driving pump 31. For example, if the pressure sensed by sensors 46 declines, controller 48 may increase the speed of pump 31 or increase the opening of choke 50. This action would increase the gas ratio in the well, causing the intake pressure of pump 31 to increase. It is likely more sensors and controls will be required.

The gas produced by cased well 11 may remain in an essentially closed loop, with little of it flowing up flow line 38. Generally, the gas ratio exiting perforations 13 is the same as the gas ratio exiting gas separator higher density outlet 37 into flow line 38.

Figure 2:
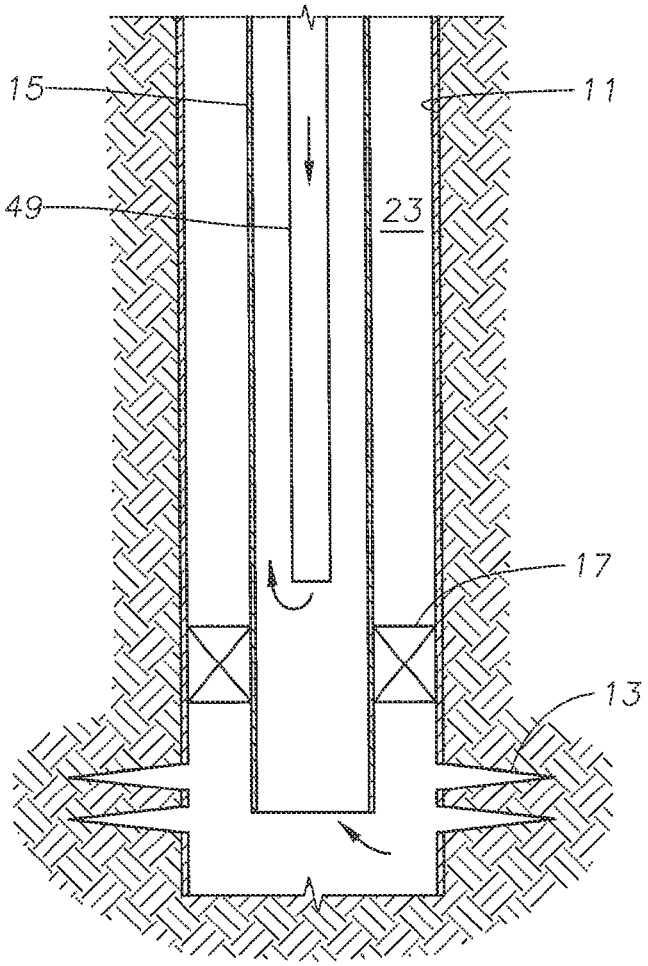
FIG. 2 is a schematic view of an alternate way to FIG. 1 of injecting gas into the well of FIG. 1, employing a gas injection tube rather than a gas lift mandrel.

Some subsea wells do not have a gas lift mandrel 19 in the production tubing 15. Referring to FIG. 2, in that event a gas injection tube 49 may be inserted into production tubing 15. Components in FIGS. 2-6 that are essentially the same as in FIG. 1 have the same reference numerals. Gas injection tube 49 has a lower end at a selected depth in production tubing 15, which may be a short distance above packer 17. Gas injection tube 49 may comprise coiled tubing. The upper end of gas injection tube 49 will be supported in production tree 25 (FIG. 1) in fluid communication with sea floor gas injection line 47 (FIG. 1). The embodiment of FIG. 2 operates in the same manner as the embodiment of FIG. 1. In the FIG. 2 embodiment, gas is not injected in tubing annulus 23.

Figure 3:
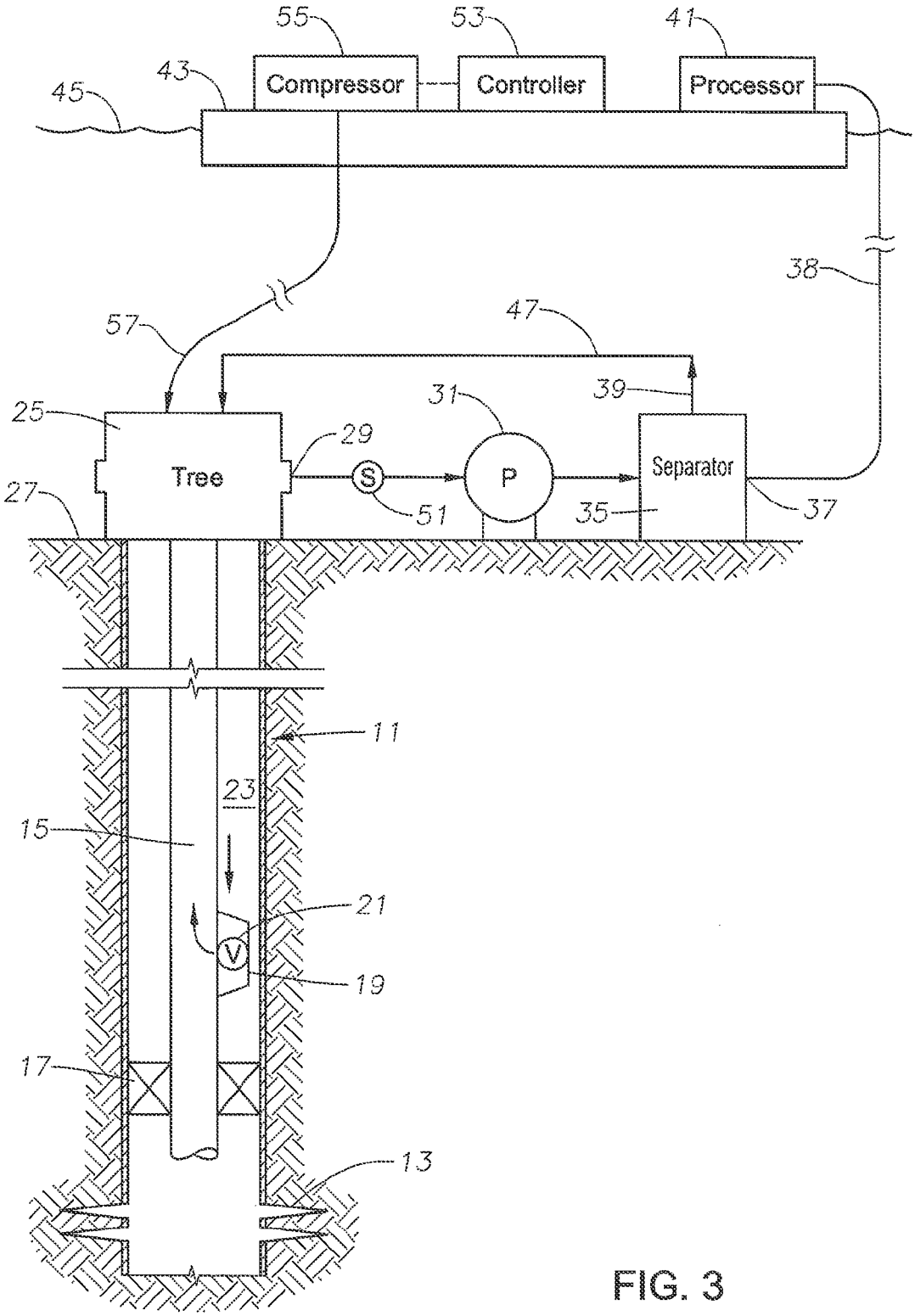
FIG. 3 is a schematic view of an alternate subsea well pumping system to the system of FIG. 1, employing an external supply of gas for injection.

In FIG. 3, sensors 51 in tree outlet 29 or other subsea locations monitor the gas content in the well fluid flowing up production tubing 15. Sensors 51, which may include pressure and temperature sensors, provide readings to a controller 53, which may be located on production vessel 43. A compressor 55, which also may be located on production vessel 43 or on the sea floor and controlled by controller 53, delivers compressed gas via a gas flow line 57 to tree 25. Alternately, a subsea tank or accumulator (not shown) may be employed at the sea floor to store and inject gas into annulus 23. The gas need not be natural or production gas produced by perforations 13. Rather the gas could be a non production gas such as nitrogen.

The gas will flow from gas lift mandrel 19 into production tubing 15 when sensors 51 determine that the amount of gas entering pump 31 is inadequate to maintain the desired gas lift. Separator 35 will separate the gas from the well fluid being pumped by pump 31 and deliver the gas to sea floor injection line 47 in the same manner as in FIG. 1. A choke or valve (not shown) in injection line 47 may also be controlled by controller 53. The embodiment of FIG. 3 could alternately use a gas injection tube within tubing 15, as shown in FIG. 2, rather than a gas lift mandrel 19.

Figure 4:
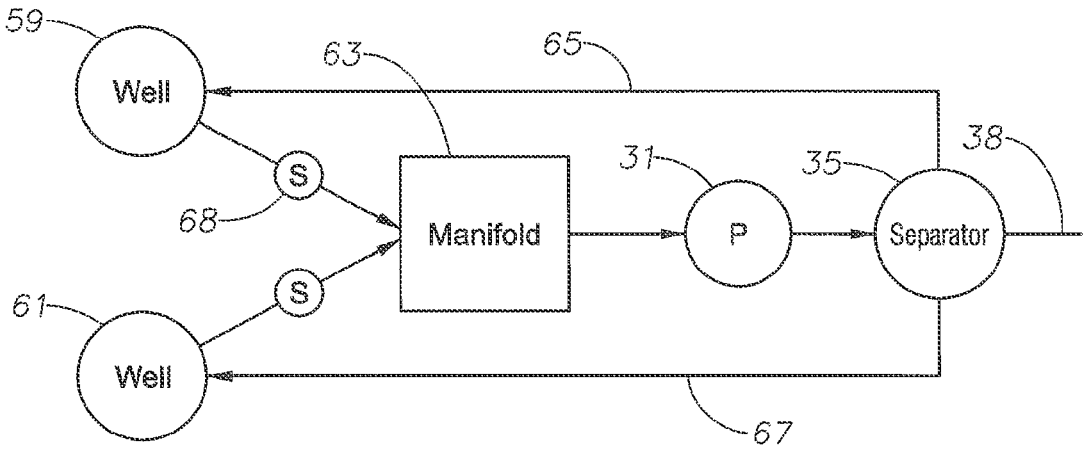
FIG. 4 is a schematic view of an alternate to the subsea well pumping system of FIG. 1, showing gas injection into multiple wells by a single pumping system.

More than one cased well 11 could deliver well fluid containing injected gas to pump 31. In FIG. 4, a plurality of wells 59, 61 (two shown) are connected to a sea floor manifold 63. Manifold 63 combines the well fluid flows from wells 59, 61 and delivers the combined well fluid flow to pump 31. Pump 31 applies pressure to the well fluid and delivers the elevated pressure well fluid to separator 35. Separator 35 separates at least part of the gas from the elevated pressure well fluid and directs the separated gas to separate sea floor gas injection lines 65, 67 leading to wells 59, 61, respectively. Sensors 68 monitor the gas/liquid ratio at each tree outlet 29, and a controller (not shown) controls the quantity of separated gas flowing back through each sea floor gas injection line 65, 67.

The amount of gas flowing through each sea floor gas injection line 65, 67 may differ. Gas optionally may be recirculated back into only one of the wells 59, 61. The multiple well embodiment of FIG. 4 could be employed with all of the other embodiments.

Alternately, one or more of the wells 59, 61 of the FIG. 4 embodiment could be completely non gas producing. For example, well 61 could be non gas producing while well 59 produces more than enough gas to gas lift well 59. Separator 35 would inject into well 61 a portion of the gas produced by the well 59, and if needed, re-inject a portion of the separated gas into well 59. Possibly, gas lift of well 59 may not be required, thus the only injection may be into well 61.

Figure 5:
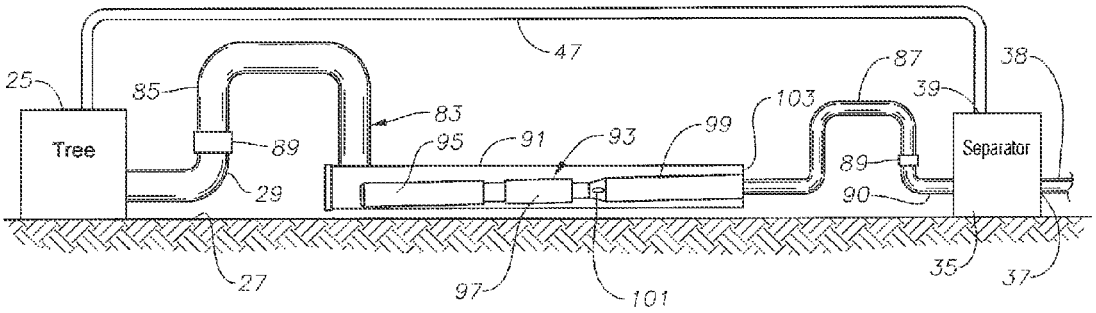
FIG. 5 is a schematic view of an alternate to the multi-phase pump of FIG. 1, showing an electrical submersible pump installed in a flow line jumper.

Referring to the embodiment of FIG. 5, a flow line jumper 83 connects tree 25 to either a manifold or gas/liquid separator 35. Flow line jumper 83 has a length sized for the spacing between tree 25 and separator 35. Flow line jumper 83 has an upstream end or inlet 85 and a downstream end or outlet 87. Connectors 89 connect jumper inlet 85 to tree outlet 29 and jumper outlet 87 to the inlet 90 of separator 35. Jumper inlet 85 and outlet 87 are illustrated to have legs that face downward for connection to the upward facing tree outlet 29 and separator inlet 90; however, they could be oriented horizontally.

Flow line jumper 83 includes an elongated horizontal chamber 91 that contains an electrical submersible pump (ESP) 93. ESP 93 boosts the pressure of the well fluid flowing from tree 25 and delivers the fluid at an elevated pressure to separator 35. ESP 93 has an electrical motor 95 that is typically a three-phase AC motor. Motor 95 is filled with a dielectric lubricant for lubricating and cooling. A seal section 97 connects to motor 95 for sealing the lubricant within motor 95 and reducing a pressure difference between well fluid pressure in chamber 91 and the lubricant pressure.

A rotary pump 99 driven by motor 95 connects to seal section 97. Pump 99 may be a centrifugal pump having a large number of stages, each stage having an impeller and diffuser. Each stage is preferably a mixed flow type, which causes the well fluid to flow both radially and axially as it flows through pump 99. The stages are designed to accommodate a considerable amount of gas in the well fluid, such as up to 40%. Pump 99 has an intake 101 that is in fluid communication with well fluid flowing into chamber 91 from tree 25. Pump 99 has a discharge 103 that is isolated from the well fluid pressure within chamber 91 on the exterior of ESP 93.

In the operation of the embodiment of FIG. 5, well fluid flows from tree 25 into chamber 91 at a positive pressure. The well fluid flows past motor 95 into pump intake 101. Pump 99 increases the pressure of the well fluid relative to the pressure at jumper inlet 85. Pump 99 discharges the elevated pressure well fluid into separator 35, which separates gas from liquid, and operates in the same manner as in the other embodiments.

For maintenance or replacement of ESP 93, flow line jumper 83 is retrievable while ESP 93 remains inside. Additional flow line jumpers 83 (not shown) containing ESP's 93 could be located in parallel with flow line jumper 83, so that one ESP 93 could continue operating while another is retrieved. Optionally, a rotary gas/liquid separator driven by motor 95 could be located inside flow line jumper 83 rather than separator 35 on the exterior.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology.

The invention claimed is:

1. A method for producing at least one subsea well, comprising:

(a) installing a pump and a gas/liquid separator on a sea floor and connecting a discharge of the pump to an inlet of the separator, (b) flowing a well fluid up the well;

(c) with the separator, separating gas from liquid in the well fluid;

(d) with the pump, pumping the liquid separated to a remote production facility;

(e) injecting at a selected depth in the well and into the well fluid flowing up the well at least some of the gas separated by the separator;

(f) sensing a ratio of gas to liquid in the well fluid flowing to the pump; and (g) injecting a non production gas into the well if the ratio is less than a desired amount.

2. The method according to claim 1, further comprising:

monitoring an intake pressure of the pump; and with a controller, varying a flow rate of said at least some of the gas being injected in response to the intake pressure sensed.

3. The method according to claim 1, wherein:

step (b) comprises flowing the well fluid up a string of production tubing in the well, the production tubing having a gas lift mandrel located at the selected depth, the gas lift mandrel having a check valve; and step (e) comprises injecting said at least some of the gas into an annulus surrounding the production tubing and through the check valve into the production tubing.

4. The method according to claim 1, wherein:

step (b) comprises flowing the well fluid up a string of production tubing in the well, and the method further comprises:

lowering an injection tube in the production tubing to the selected depth; and step (e) comprises injecting said at least a portion of the gas from the gas separator into the injection tube.

5. The method according to claim 1, wherein:

step (a) comprising installing an electrical submersible pump in a flow line jumper on the sea floor; and step (a) further comprises installing the gas separator outside of the flow line jumper.

6. The method according to claim 1, wherein:

said at least one subsea well comprises a plurality of subsea wells that are connected to a manifold;

step (d) comprises flowing the well fluid from each of the wells to the manifold, and from the manifold to the pump; and step (e) comprises injecting at least some of the gas separated by the separator into at least one of the wells.

7. A method for producing at least one subsea well, comprising:

installing a pump and a gas/liquid separator on a sea floor, and connecting a discharge of the pump to an intake of the gas/liquid separator, flowing a well fluid up the well to the pump, and increasing a pressure of the well fluid with the pump;

flowing the well fluid from the pump into the gas/liquid separator and separating gas from the well fluid, creating a stream of higher density fluid and a stream of lower density fluid, both of the streams being at a same elevated pressure;

flowing the stream of higher density fluid to a remote production facility;

injecting the stream of lower density fluid at a selected depth in the well into the well fluid flowing up the well;

sensing an intake pressure of the well fluid flowing into the pump; and with a controller and in response to the intake pressure sensed, controlling a quantity of the stream of lower density fluid being injected into the well.

8. The method according to claim 7, further comprising:

mounting a choke in at least one of the streams of higher density and lower density fluid; and wherein the controller controls the choke in response to a fluid parameter sensed of the well fluid flowing into the pump.

9. The method according to claim 7, wherein:

the well has a string of production tubing having a gas lift mandrel with a check valve;

flowing the well fluid up the well comprises flowing the well fluid up the production tubing; and injecting the stream of lower density fluid comprises injecting the stream of lower density fluid into an annulus surrounding the production tubing and from the annulus through the check valve into the production tubing.

10. The method according to claim 7, wherein:

the stream of higher density fluid has a gas content substantially the same as a gas content of the well fluid at a point below the selected depth.

11. The method according to claim 7, wherein the well has a string of production tubing, and the method further comprises:

lowering an injection tube in the production tubing to the selected depth; and injecting the stream of lower density fluid comprises injecting the stream of lower density fluid into the injection tube.

12. The method according to claim 7, further comprising:

sensing a ratio of gas to liquid in the well fluid flowing to the pump; and introducing gas from the remote production facility into the well if the ratio is less than a desired amount.

13. The method according to claim 7, wherein:

said at least one subsea well comprises a plurality of subsea wells that are connected to a manifold;

flowing the well fluid to the pump comprises flowing the well fluid from each of the wells to the manifold, and from the manifold to the pump; and injecting at a selected depth comprises injecting at least some of the stream of lower density fluid into at least one of the wells.

14. The method according to claim 7, wherein the step of installing the pump and the gas/liquid separator comprises:

installing an electrical submersible pump in a flow line jumper, and connecting the flow line jumper into a subsea flow line; and installing the separator on the sea floor outside of the flow line jumper.

15. A subsea well pumping system, comprising:

a string of production tubing deployed in the well;

a pump adapted to be mounted on a sea floor, the pump having an inlet connected to the production tubing to receive well fluid flowing up the production tubing;

a gas/liquid separator adapted to be mounted on the sea floor and having an inlet connected to a discharge of the pump for separating gas from liquid in the well fluid discharged by the pump, the separator having a higher density outlet for delivering a stream of higher density fluid and a lower density outlet for delivering a stream of lower density fluid;

wherein the higher density outlet is adapted to be connected to a flow line leading to a remote production facility;

the lower density outlet is connected to the well for injecting the stream of lower density fluid into the production tubing at a selected depth; wherein the system further comprises:

a flow line jumper connected into a subsea flow line; wherein the pump comprises an electrical submersible pump mounted in the flow line jumper; and the separator is located exterior of the flow line jumper.

16. The system according to claim 15, wherein a pressure at the higher density outlet is the same as a pressure at the lower density outlet.

17. The system according to claim 15, further comprising:

a gas lift mandrel located in the production tubing at the selected depth, the gas lift mandrel having a check valve; and wherein the lower density outlet is connected to an annulus surrounding the production tubing and injects the stream of lower density fluid into the annulus, the stream of lower density fluid flowing through the check valve into the production tubing.

18. The system according to claim 15, further comprising:

an injection tube extending to the selected depth in the production tubing; and wherein the lower density outlet is connected to the injection tube.

* * * * *